US010822157B2

(12) United States Patent
Baker

(10) Patent No.: US 10,822,157 B2
(45) Date of Patent: Nov. 3, 2020

(54) PRESSURE GAUGE FOR AEROSOL CONTAINER AND DIP TUBE ADAPTOR FOR SAME

(71) Applicant: Clayton Corporation, Fenton, MO (US)

(72) Inventor: Mark Baker, St. Louis, MO (US)

(73) Assignee: Clayton Corporation, Clayton, MO (US)

( * ) Notice: Subject to any disclaimer, the term of this patent is extended or adjusted under 35 U.S.C. 154(b) by 0 days.

(21) Appl. No.: 15/999,037

(22) Filed: Aug. 17, 2018

(65) Prior Publication Data

US 2019/0055080 A1 Feb. 21, 2019

Related U.S. Application Data

(60) Provisional application No. 62/546,695, filed on Aug. 17, 2017.

(51) Int. Cl.

| | |
|---|---|
| ***B65D 83/48*** | (2006.01) |
| ***B05B 12/00*** | (2018.01) |
| ***A62C 13/64*** | (2006.01) |
| ***A62C 13/00*** | (2006.01) |
| ***B65D 83/32*** | (2006.01) |
| *B65D 83/46* | (2006.01) |

(52) U.S. Cl.

CPC ..... *B65D 83/48* (2013.01); *A62C 13/003* (2013.01); *A62C 13/006* (2013.01); *A62C 13/64* (2013.01); *B05B 12/008* (2013.01); *B65D 83/32* (2013.01); *B65D 83/46* (2013.01)

(58) Field of Classification Search

CPC ..... B65D 83/48; A62C 13/003; A62C 13/006; A62C 13/64

See application file for complete search history.

(56) References Cited

U.S. PATENT DOCUMENTS

| | | | | |
|---|---|---|---|---|
| 3,202,319 | A * | 8/1965 | Howard | B65D 83/70 222/41 |
| 3,229,851 | A | 1/1966 | Horwitt et al. | |
| 3,704,814 | A | 12/1972 | Ruscitti | |
| 3,786,963 | A | 1/1974 | Metzler, III | |
| 3,851,799 | A | 12/1974 | Paoletti | |
| 4,850,517 | A | 7/1989 | Ter Stege | |
| 5,450,983 | A | 9/1995 | Stern et al. | |
| 5,636,770 | A | 6/1997 | Hachinohe et al. | |
| 6,907,876 | B1 | 6/2005 | Clark et al. | |
| 7,004,164 | B2 | 2/2006 | Scarrott | |
| 7,614,298 | B2 | 11/2009 | Bohmer | |
| 9,144,699 | B1 * | 9/2015 | Wang | A62C 13/70 |
| 2004/0084481 | A1 | 5/2004 | Foster et al. | |
| 2007/0062521 | A1 | 3/2007 | Bohmer | |

(Continued)

OTHER PUBLICATIONS

International Search Report and Written Opinion, Application No. PCT/IB18/56244, dated Dec. 14, 2018, pp. 13.

*Primary Examiner* — Jeremy Carroll
(74) *Attorney, Agent, or Firm* — Stinson LLP

(57) ABSTRACT

A pressure gauge for an aerosol container includes a scale attached to the container body and a pointer associated with and movable relative to the scale. The pointer is operatively coupled to a valve assembly of the aerosol container. The pointer moves relative to the scale in response to movement of at least a portion of the valve assembly due to internal pressure in the container body to provide a reading.

17 Claims, 15 Drawing Sheets

(56) References Cited

U.S. PATENT DOCUMENTS

| | | | | |
|---|---|---|---|---|
| 2009/0032272 | A1* | 2/2009 | Duncan | A62C 13/00<br>169/85 |
| 2014/0338931 | A1* | 11/2014 | Mori | A62C 13/64<br>169/71 |
| 2016/0159556 | A1* | 6/2016 | Brouwer | B65D 83/64<br>222/399 |
| 2017/0001051 | A1* | 1/2017 | Kronebusch | A62C 13/64 |

* cited by examiner

PRESSURE GAUGE FOR AEROSOL CONTAINER AND DIP TUBE ADAPTOR FOR SAME

CROSS-REFERENCE TO RELATED APPLICATION

The present application claims the benefit of U.S. Provisional Application No. 62/546,695, filed Aug. 17, 2017, the entirety of which is hereby incorporated by reference.

FIELD OF THE DISCLOSURE

The present disclosure generally relates to components for an aerosol container, such as a pressure gauge and a dip tube adaptor, and an aerosol container assembly including the same.

BACKGROUND OF THE DISCLOSURE

Hand-held, aerosol fire suppressors include flowable fire suppressant material contained under pressure within an aerosol container. The flowable fire suppressant material is released by actuating a valve on the container. Hand-held, aerosol fire suppressors are easily storable, convenient, and easy to use.

SUMMARY OF THE DISCLOSURE

In one aspect, a pressure gauge for an aerosol container interacts with a valve assembly of the aerosol container to detect movement of the valve assembly relative to a container body of the aerosol container resulting from changes of pressure inside the container body.

In another aspect, an aerosol container assembly for a flowable product includes a container body defining an interior configured to contain the flowable product under pressure. A valve assembly is secured to the container body. The aerosol container includes a pressure gauge for detecting the internal pressure in the container body. The pressure gauge has a scale attached to the aerosol container and a pointer associated with and movable relative to the scale. The pointer is operatively coupled to the valve assembly and moves relative to the scale in response to movement of at least a portion of the valve assembly due to internal pressure in the container body to provide a reading.

In another aspect, a dip tube adaptor for an aerosol container has a housing with upper and lower ends. The upper end is configured to be coupled to a valve assembly of the aerosol container and the lower end is configured to be coupled to a dip tube of the aerosol container. The housing defines a mixing chamber positioned between the upper and lower ends of the housing. The mixing chamber is configured to be in fluid communication with the valve assembly when the upper end of the housing is coupled to the valve assembly. The housing further defines a flowable product inlet in fluid communication with the mixing chamber. The flowable product inlet is configured to be in fluid communication with the dip tube when the lower end of the housing is coupled to the dip tube. The housing further defines at least one propellant inlet in constant fluid communication with the mixing chamber. The at least one propellant inlet is configured to be in fluid communication with the interior of the container when the upper end of the housing is coupled to the valve assembly. The housing is configured to provide fluid communication between the dip tube and the valve assembly and between the interior and the valve assembly, simultaneously. When the valve assembly is selectively operated to dispense a flowable product from the aerosol container, the flowable product flows into the mixing chamber through the flowable product inlet and, simultaneously therewith, the propellant flows into the mixing chamber through the at least one propellant inlet. The flowable product and propellant then mix in the mixing chamber such that the flowable product foams before moving into the valve assembly.

BRIEF DESCRIPTION OF THE DRAWINGS

Corresponding reference characters indicate corresponding parts throughout the drawings.

DETAILED DESCRIPTION OF THE DISCLOSURE

Figure 1:
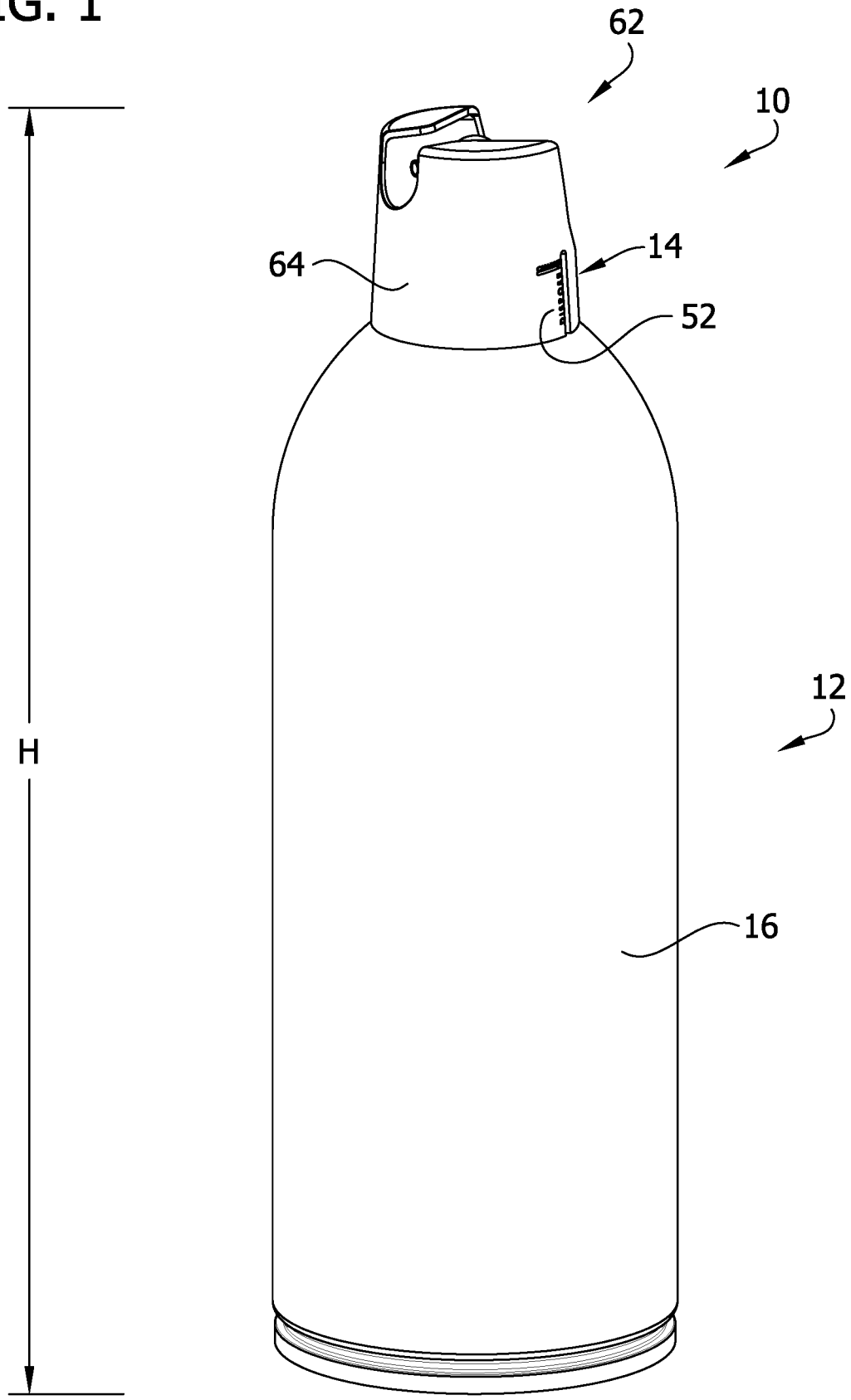
FIG. 1 is a perspective of one embodiment of a hand-held, disposable aerosol fire suppressor.

Referring to FIG. 1, one embodiment of a hand-held, disposable aerosol container assembly for a flowable product is generally indicated at reference numeral 10. The illustrated aerosol container assembly is configured as a fire suppressor, although in other embodiments the aerosol container assembly may be configured as a different type for delivering a different type of flowable product using a pressurized propellant. In general, the fire suppressor 10 comprises an aerosol container, generally indicated at reference numeral 12, and a pressure gauge, generally indicated at reference numeral 14, coupled to the aerosol container. The aerosol container assembly 10 has a height H (FIG. 1) extending between the upper and lower ends thereof. As explained in more detail below, the pressure gauge 14 is configured to provide a visual indication based on the pressure within the aerosol container. Over time, the aerosol container 12 may lose some or substantially all of its charge (i.e., the pressure within the container may decrease) such that the fire suppressor 10 may not operate properly for suppressing or extinguishing a fire. In general, the pressure gauge 14 may be configured to indicate to the user whether aerosol container 12 has a suitable charge for operating properly.

Figure 2:
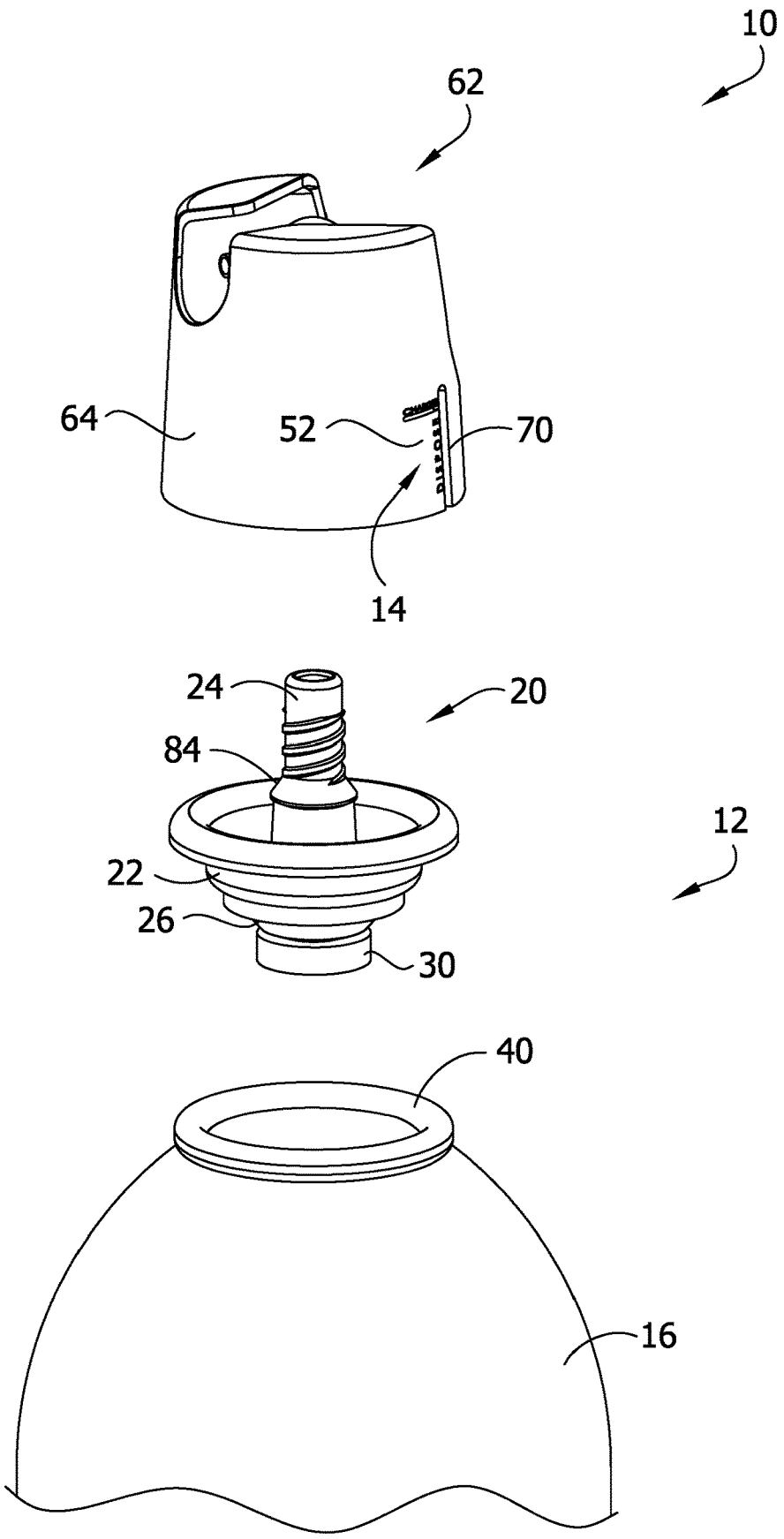
FIG. 2 is an enlarged, exploded perspective of the fire suppressor.
Figure 3:
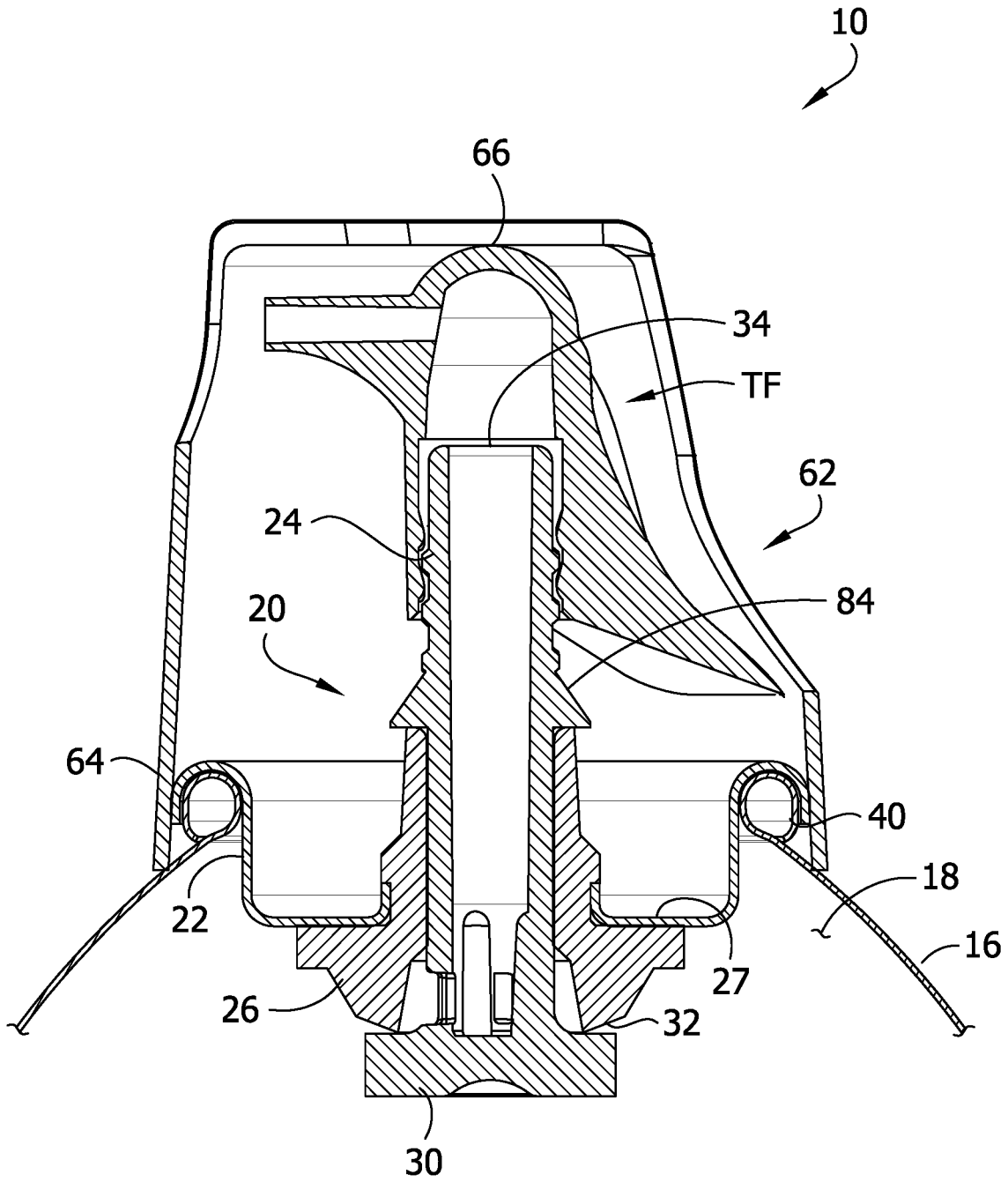
FIG. 3 is an enlarged cross section of an upper end of the fire suppressor.
Figure 4:
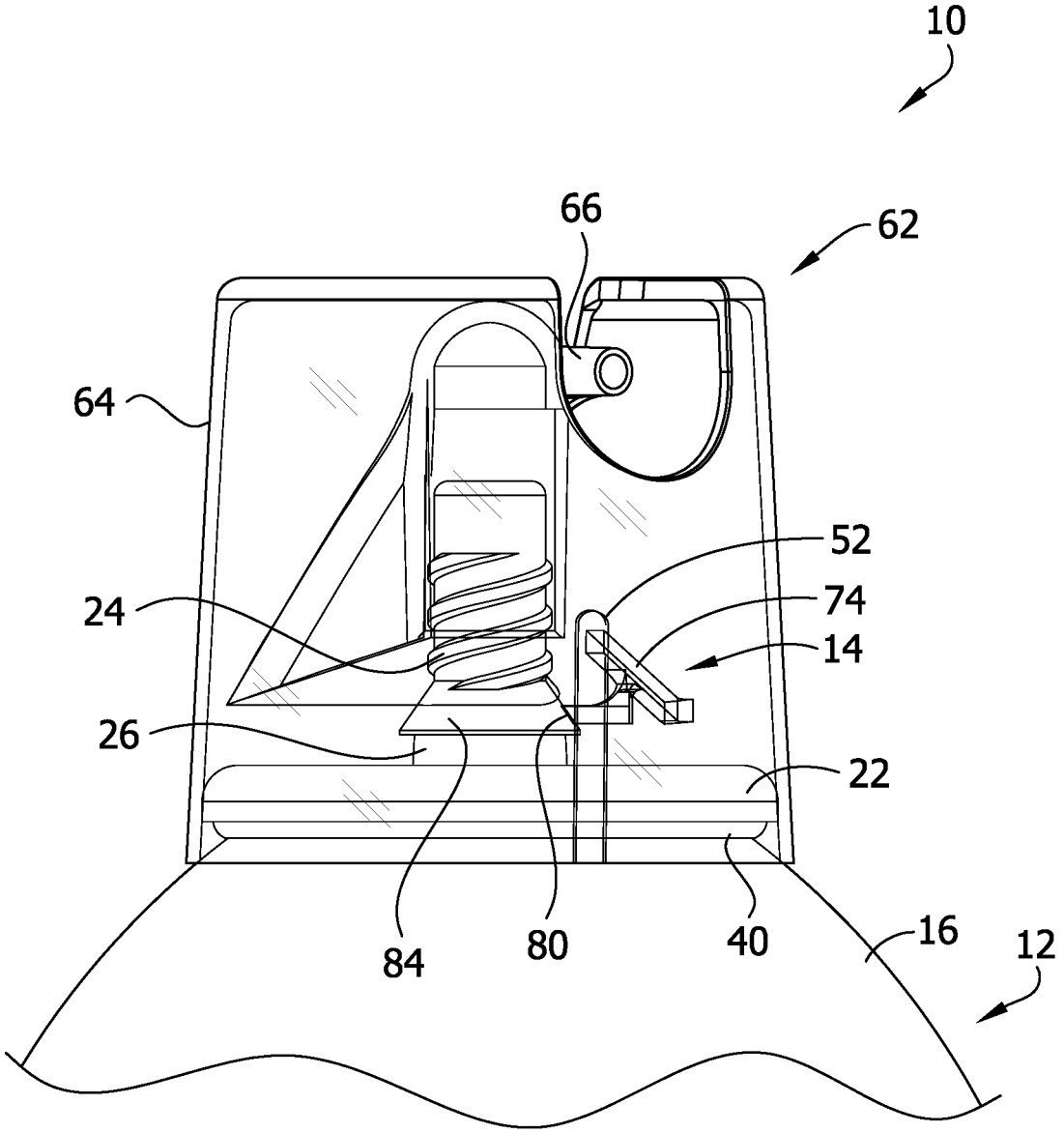
FIG. 4 is an enlarged perspective of the upper end of the fire suppressor, a cap of the suppressor being transparent.
Figure 5:
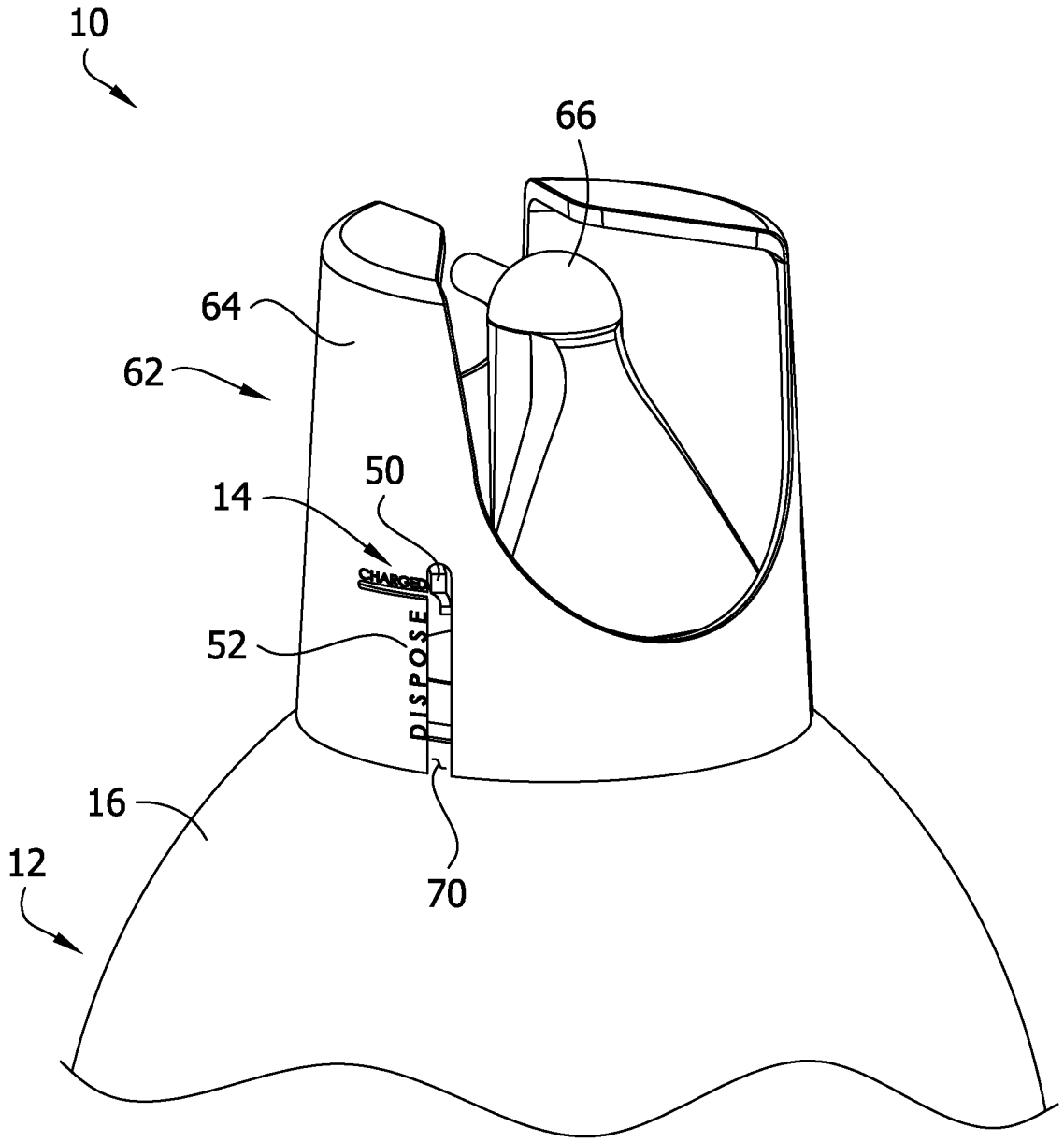
FIG. 5 is an enlarged perspective of the upper end of the fire suppressor.
Figure 6:
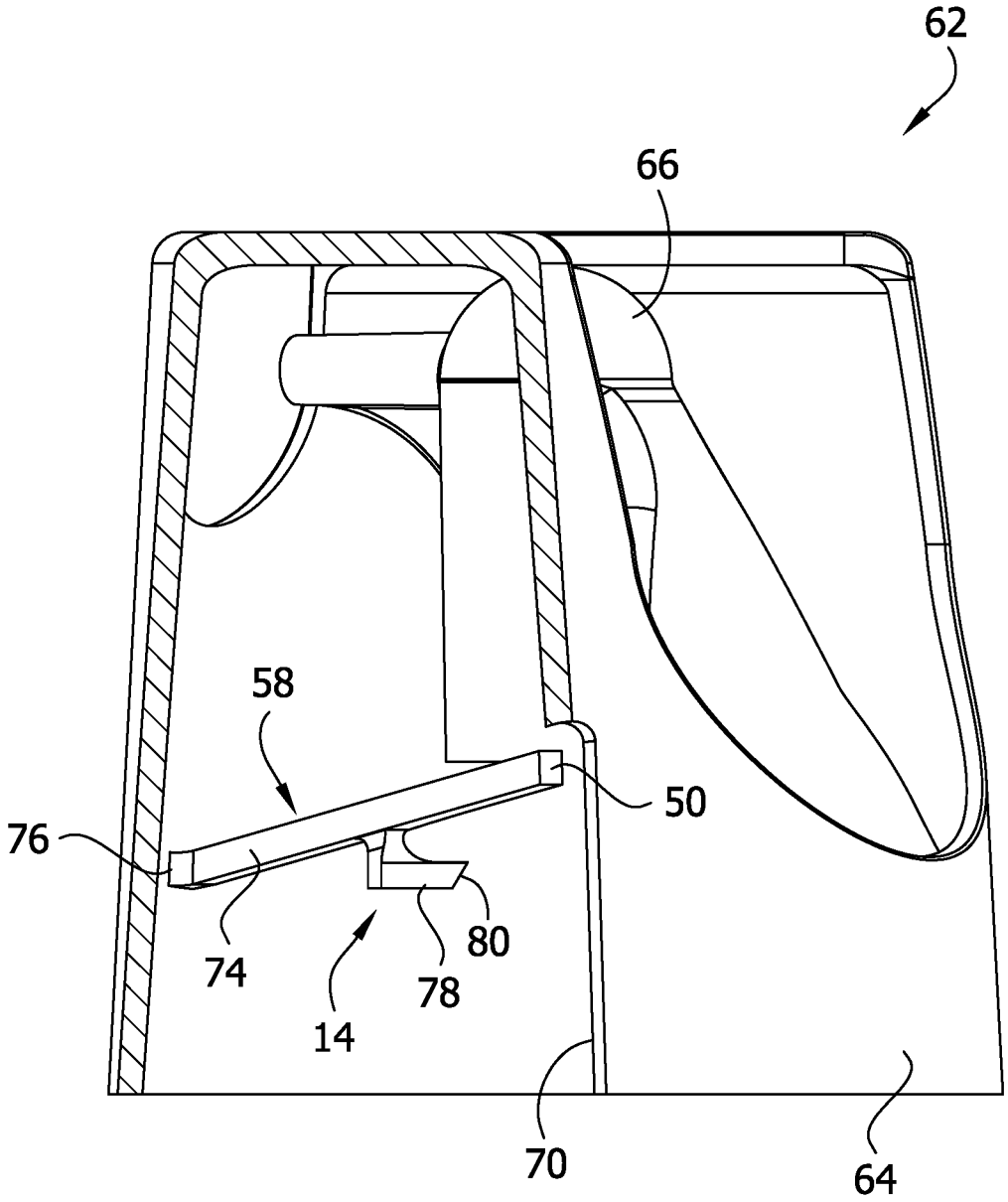
FIG. 6 is an enlarged elevational view of the cap of the suppressor, a portion of the cap broken away to show internal structure.
Figure 7:
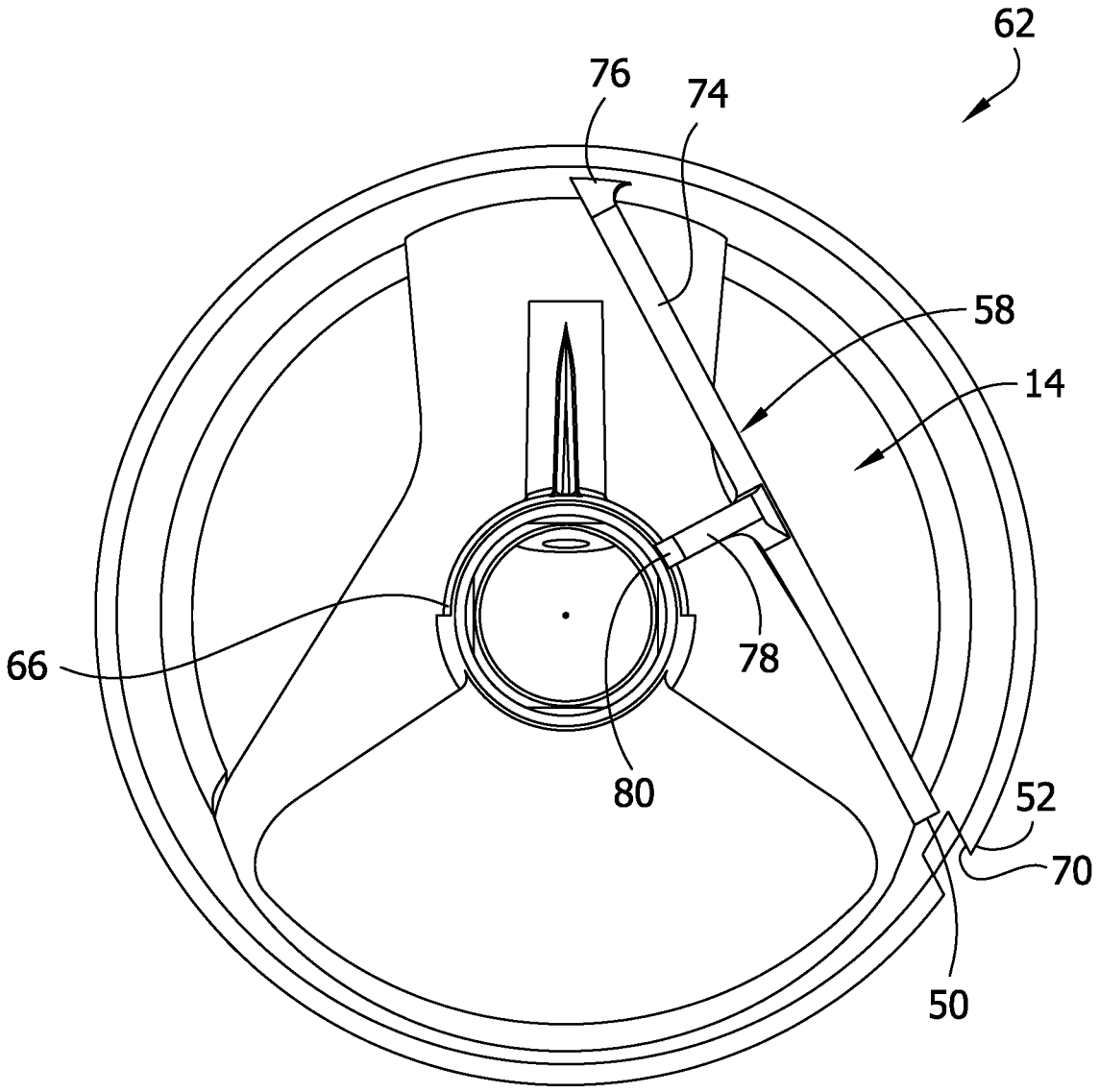
FIG. 7 is a bottom plan view of the cap.

Referring to FIGS. 2 and 3, the illustrated aerosol container 12 includes a container body 16 defining an interior 18 in which a flowable fire suppressant and a propellant are contained, and a valve assembly 20 attached to an upper end of the container body. As an example, the container body 16 may be suitable for holding pressurized fire suppressant, which may be pressurized by nitrogen or other gas (e.g., propellant). The container body 16 may be formed from metal or other material, for example.

The illustrated valve assembly 20 includes a mounting cup 22, a stem 24, and a seal (e.g., a grommet) 26 attached to the stem and disposed between and interconnecting the stem and the mounting cup. The stem 24 and the seal 26 extend through an opening in a bottom wall 27 of the mounting cup 22. The mounting cup 22 may be formed from metal or other material. The stem 24 may be formed from a rigid plastic or other material. The seal 26 may be formed from a resilient rubber or other material. The illustrated valve assembly 20 may be actuated by tilting or applying a vertical force to the stem 24. The illustrated valve assembly 20 is actuated by tilting the stem 24. To open the valve assembly 20, a tilt force TF (FIG. 3) is applied to the stem 24, such as by pressing on a nozzle 66 (broadly, an actuator) secured to the stem 24, to unseat a disc 30 from a seat portion 32 of the seal 26, whereby the pressurized flowable fire suppressant in the container body 16 flows through the valve assembly, such as through the stem 24 and through an outlet 34 of the valve assembly, and into the nozzle 66. In this embodiment, the tilt force TF is applied in a direction that is generally the same as the direction the nozzle 66 directs the flowable product (e.g., a forward direction). It is understood that the valve assembly 20 may be of other designs and constructions without necessarily departing from the scope of the present disclosure.

Before internal pressurization or charging of the aerosol container 12, the mounting cup 22 is crimped or clinched on a bead 40 at an upper end of the container body 16 to secure the valve assembly 20 to the container body. At least portions of the valve assembly 20 (e.g., the bottom wall 27 of the mounting cup 22, the seal 26, and/or the stem 24) have an initial position (e.g., initial heightwise position) relative to the container body 16 (e.g., the bead 40) before charging. During internal pressurization or charging of the aerosol container 12 (e.g., with a propellant gas), at least a portion of the valve assembly 20 (e.g., the bottom wall 27 of the mounting cup 22, the seal 26, and/or the stem 24) is displaced axially upward relative to the container body 16. This upward axial displacement may be referred to as "cup rise." In particular, in at least some embodiments, internal pressure is exerted on the valve assembly 20, which imparts deformation of the mounting cup 22 in an upward axial direction, for example. This upward axial displacement is imparted to the seal 26 and the stem 24 such that the seal and the stem are also displaced upwardly relative to the container body 16 and, in particular, relative to the bead 40 of the container body. As an example, the upward axial displacement of the valve assembly 20 (or cup rise) from its initial heightwise position to its fully charged heightwise position may be, in some examples, from about 0.020 in (0.508 mm) to about 0.060 in (1.524 mm). As internal pressure decreases in the aerosol container 12, due to use of the fire suppressor 10 and/or leakage of propellant gas during storage, the valve assembly 20 rebounds toward its initial heightwise position. Thus, after charging, the displacement of the bottom wall 27 of the mounting cup 22, the seal 26, and/or the stem 24, for example, relative to the container body (e.g., the bead 40) from an initial position is indicative of the amount of pressure or charge within the container body. If the valve assembly position after charging falls below a preselected, determined threshold, this is indicative of the fire suppressor 10 not being suitable for use.

In general, the illustrated pressure gauge 14 is operatively coupled to the valve assembly 20 to detect the heightwise position of at least portions of the valve assembly (e.g., the bottom wall 27 of the mounting cup 22, the seal 26, and/or the stem 24) to indicate to the user whether the fire suppressor 10 is suitable for use, for example, has a suitable charge or internal pressure for operating properly. The illustrated pressure gauge 14 includes a pointer 50 operatively coupled to at least one of the bottom wall 27 of the mounting cup 22, the seal 26, and/or the stem 24, and a scale 52 associated with the pointer. Together, the pointer 50 and the scale 52 may be considered a visual indicator of the pressure gauge 14 providing a reading or indication of the suitability of using the fire suppressor 10. As explained in more detail below, the illustrated pressure gauge 14 further includes a mechanical amplifier, generally indicated at 58, to amplify the heightwise position of the valve assembly 20 relative to the upper end (e.g., the bead 40) of the container body 16 and transmit the amplified position to the pointer 50. In the illustrated embodiment, the pressure gauge 14 is incorporated in a cap, generally indicated at 62, of the fire suppressor 10. The cap 62 also includes a shroud 64 that is configured to be attached to the aerosol container 12, such as by press-fit or snap-fit connection to the bead 40 and/or the mounting cup 22, and the nozzle 66 disposed within the shroud that is configured to be attached to the stem of the valve assembly, such as by threading on the stem. The cap 62 may be formed as an integral, one-piece component, or one or more of the pressure gauge 14, the shroud 64, and the nozzle 66 may be separate components and secured to the aerosol container 12 separately. In such an embodiment, the entire cap 62, including the nozzle 66 and pressure gauge 14, may be broadly considered an actuator.

The pointer 50 is movable relative to the scale 52 in response to the heightwise displacement of the valve assembly 20 to detect the position/displacement of the bottom wall 27 of the mounting cup 22, the seal 26, and/or the stem 24 relative to the upper end of the aerosol container 12 after charging. The illustrated scale 52 is incorporated in (i.e., is part of) the shroud 64 of the cap 62. The shroud 64 and the scale 52 do not move relative to the container body 16 in response to the change in pressure in the container body (i.e., movement of the valve assembly 20 relative to the container body 16 due to changes in internal pressure or charge does not impart movement to the shroud or the scale). In the illustrated embodiment, the scale 52 is binary in that it is graduated with indicia to indicate that the aerosol container 12 is either suitably pressurized or charged for use or is not suitably pressurized or charged and, for example, should be disposed. The illustrated scale 52 also includes a window 70 (e.g., a vertical slot) defined by the shroud 64 of the cap 62 adjacent a lower end of the shroud and through which the pointer 50 is visible. In the illustrated embodiment, when the fire suppressor 10 has an internal pressure at or above a threshold pressure, the pointer 50 is disposed at or near the upper end of the window 70 adjacent to the indicia of the scale 52 (e.g., "CHARGED," as illustrated), indicating that the suppressor is suitable for use. When the fire suppressor 10 does not have an internal pressure at or above a threshold pressure, the pointer 50 is disposed below the upper end of the window 70 adjacent to indicia of the scale 52 (e.g., "DISPOSE," as illustrated) indicating that the suppressor is not suitable for use. In one embodiment, the pointer 50 has a color that is different from the color(s) of the scale 52 and/or cap 62 to visually distinguish the pointer from the scale and/or cap. It is understood that the pointer 50 and/or the scale 52 may be of other configurations or designs without necessary departing from the scope of the present disclosure.

The illustrated mechanical amplifier 58 includes a linkage mechanism coupling the valve assembly 20 to the pointer 50. The illustrated linkage mechanism includes a lever 74 that pivots about a fulcrum relative to the scale 52 in response to the heightwise displacement of the bottom wall 27 of the mounting cup 22, the seal 26, and/or the stem 24 relative to the upper end of the aerosol container 12. In particular, the lever 74 has a connected end hingedly connected to an inner wall of the shroud 64 by a living hinge 76 or another type of hinge, and a free end, which in the illustrated embodiment, forms the pointer 50 that is visible through the window 70. As such, in the illustrated embodiment, the lever 74 and the pointer 50 are integrally formed as a one-piece component, although in other embodiments, the components may be formed separately. The lever 74 generally extends through a cap interior defined by the cap 62 from the living hinge 76 at a first position on the shroud 64 to the scale 52 at a second position on the shroud. The second position is spaced apart from the first position such that the lever 74 extends generally across the cap interior.

The linkage mechanism further includes a coupler arm 78 operatively connected to the lever 74, such as by being integrally formed therewith, such that movement of the coupler arm results in corresponding movement of the lever. The coupler arm 78 extends laterally outward (e.g., perpendicular) from the lever 74 at a location between the connected and free ends thereof. The coupler arm 78 has a coupling end 80 that interfaces with the valve assembly 20, and more particularly, with the stem 24. The illustrated coupling end 80 of the coupler arm 78 has a beveled surface that rests on an annular, sloping shoulder 84 of the stem 24. As a result, any heightwise (e.g., vertical) displacement/movement of the stem 24 relative to the container body 16 moves the coupler arm 78 in the heightwise direction and, thereby, moves the pointer 50 relative to the window 70. In other embodiments, the coupling end 80 may be secured to the sloping shoulder 84 of the stem 24 or at another location on the stem. In one or more other embodiments, the linkage mechanism may be configured to interface with (e.g., engage or secured to) another component of the valve assembly 20, other than the stem 24 (e.g., the mounting cup 22 or the seal 26) that experiences heightwise displacement in response to the internal pressure of the aerosol container 12. In yet other embodiments, the linkage mechanism may couple with the valve assembly 20 in other ways for transmitting displacement of the valve assembly due to internal pressure within the aerosol container to the pointer 50 or another type of visual indicator.

In general, the heightwise displacement/position of the valve assembly 20 is a mechanical signal indicative of the internal pressure of the fire suppressor 10, and the pointer 50 is the signal output after amplification by the mechanical amplifier 58. The amplified mechanical signal is imparted to the pointer 50 such that the displacement of the pointer is a multiple of the displacement of the valve assembly 20 relative to the container body 16, where a multiplier is greater than 1. In one example, the multiplier may be from about 1.25 to about 10, or from about 1.5 to about 10, or from about 2 to about 8, or from about 2.5 to about 5. Through the mechanical amplifier 58, a relatively small displacement or movement of the valve assembly 20 relative to the container body 16 due to internal pressure of the aerosol container 12 imparts a greater displacement of the pointer 50 relative to the scale 52 so that a change in the position of the pointer relative to the scale 52 is visually noticeable. In other embodiments, the linkage mechanism may be of other designs and/or constructions for amplifying the mechanical signal (e.g., heightwise change of the valve assembly 20) indicative of the internal pressure of the aerosol container 12. It is understood that in some embodiments, the pressure gauge 14 may not include the mechanical amplifier 58.

Figure 8:
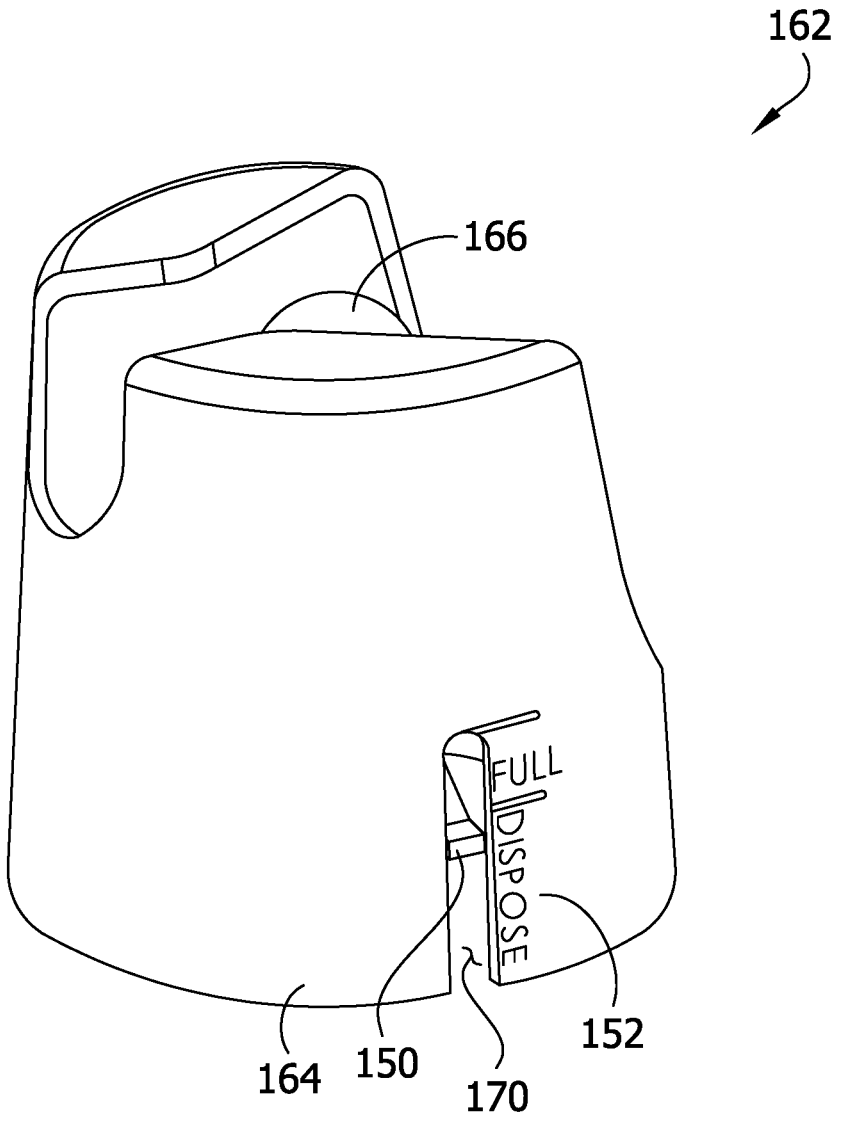
FIG. 8 is a perspective of another embodiment of a cap for a hand-held, disposable aerosol fire suppressor.
Figure 9:
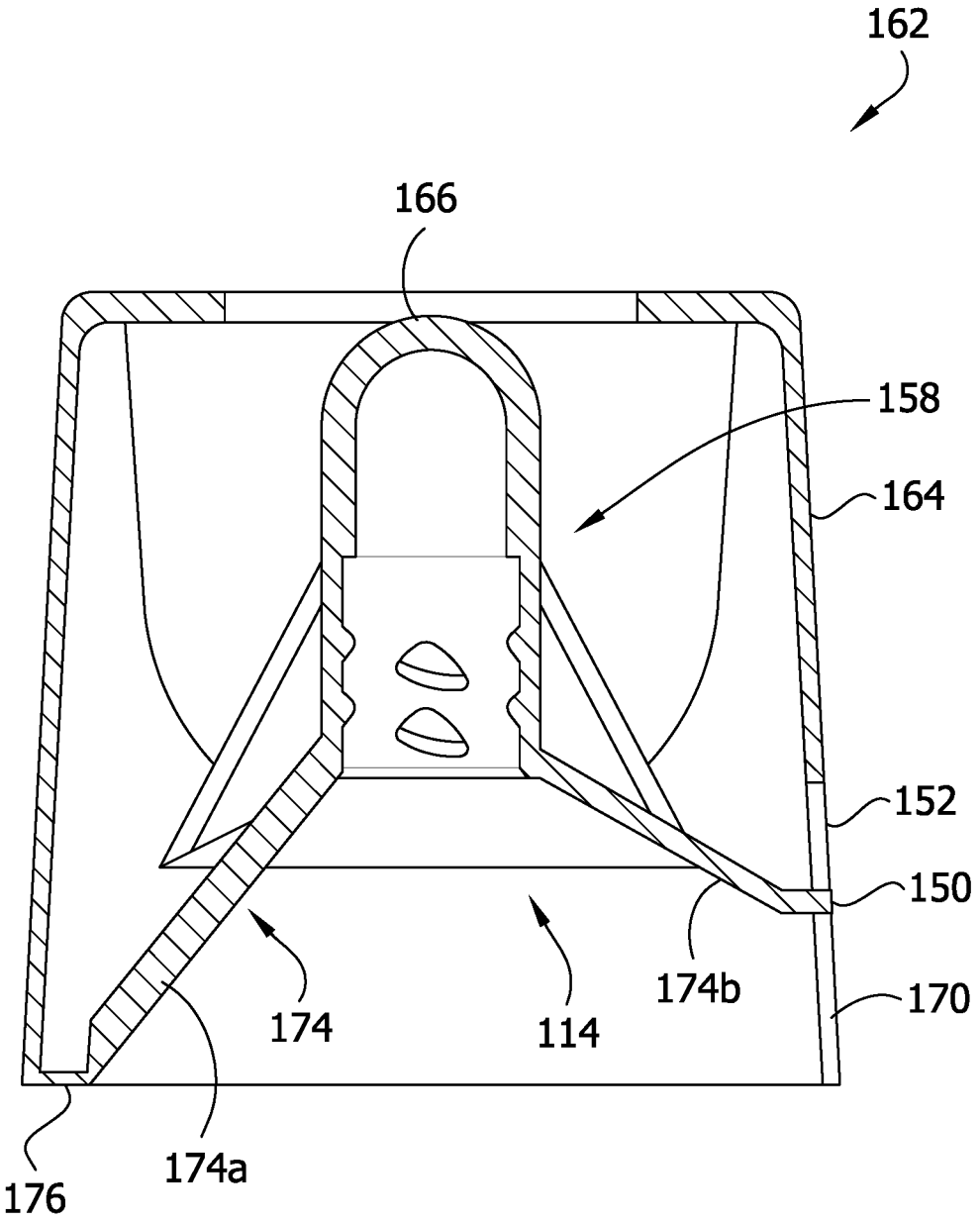
FIG. 9 is a cross section of the cap in FIG. 8

Referring to FIGS. 8 and 9, another embodiment of a cap, generally indicated at 162, includes a pressure gauge, generally indicated at 114, for a hand-held, disposable aerosol fire suppressor 10. Like the cap 62, the present cap 162 also includes a shroud 164 that is configured to be attached to the aerosol container 12, such as by a press-fit or snap-fit connection, and a nozzle 166 within the shroud that is configured to be attached to the stem 24 of the valve assembly 20, such as by threading on the stem. The cap 162 may be formed as an integral, one-piece component, or one or more of the pressure gauge 114, the shroud 164, and the nozzle 166 may be separate components and secured to the aerosol container 12 separately. In this embodiment, the illustrated linkage mechanism of a mechanical amplifier 158 includes a lever, generally indicated at 174, that pivots about a fulcrum relative to the scale 152 in response to the heightwise displacement of the valve assembly 20. In particular, the lever 174 includes first and second lever arms **174*a*, 174*b*. The first lever arm 174*a* has a first end hingedly connected to an inner wall of the shroud 164 by a living hinge 176 or type of other hinge, and a second end connected to the nozzle 166. A second lever arm 174*b* has a first end connected to the nozzle 166 and a free end, which in the illustrated embodiment, forms a pointer 150 that is visible through the window 170. As such, in the illustrated embodiment, the lever 174 and the pointer 150 are integrally formed as a one-piece component, although in other embodiments, the components may be formed separately. The lever 174 generally extends from the living hinge 176 at a first location on the shroud 164 to the scale 152 at a second location on the shroud. In the illustrated embodiment, the second location is spaced apart from and generally opposite to the first location such that the lever 174 extends generally across the interior of the shroud 164 between opposite sides of the shroud. As can be understood, the lever 174 pivots about the living hinge 176 in response to heightwise movement of the stem 24 due to changes in internal pressure in the aerosol container 12 and imparts movement of the pointer 150 relative to the scale 152**, as explained above with respect to the first embodiment.

Referring to FIGS. 10-14, another embodiment of a cap, generally indicated at 262, includes a pressure gauge, generally indicated at 214, for a hand-held, disposable aerosol fire suppressor 10 or other pressurized container. In this embodiment, the pressure gauge 214 is configured to provide a visual indication of the pressure within the aerosol container 12 (similar to pressure gauges 14, 114) and to provide a visual indication when the aerosol container has been used (e.g., indicate if flowable product has been dispensed from the aerosol container). Like the caps 62 and 162, the present cap 262 also includes a shroud 264 that is configured to be attached to the aerosol container 12, such as by a press-fit or snap-fit connection, and a nozzle 266 within the shroud that is configured to be attached to the stem 24 of the valve assembly 20, such as by threading on the stem. The cap 262 may be formed as an integral, one-piece component, or one or more of the pressure gauge 214, the shroud 264, and the nozzle 266 may be separate components and secured to the aerosol container 12 separately.

Figure 10:
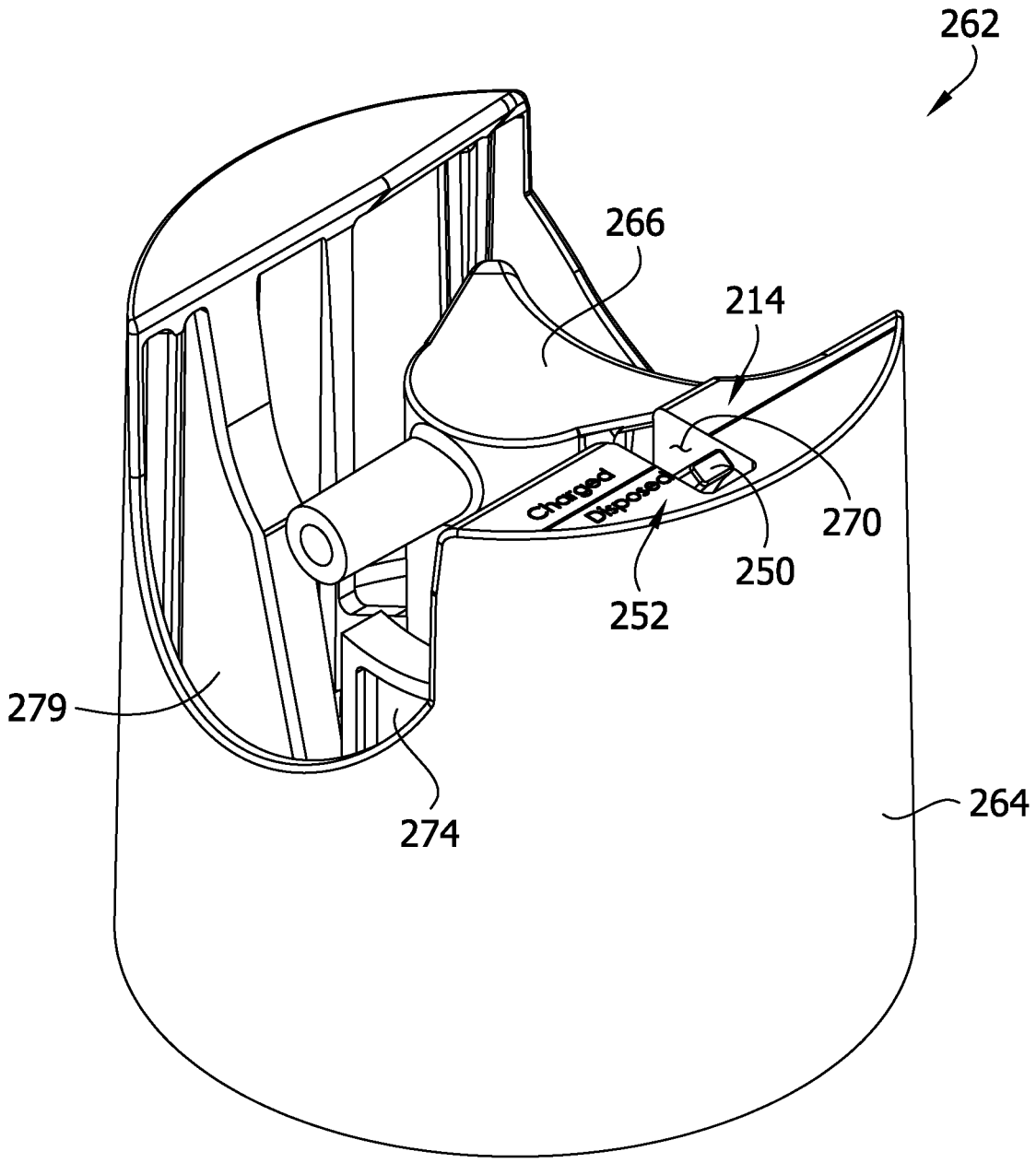
FIG. 10 is a perspective of another embodiment of a cap for a hand-held disposable aerosol fire suppressor.
Figure 13:
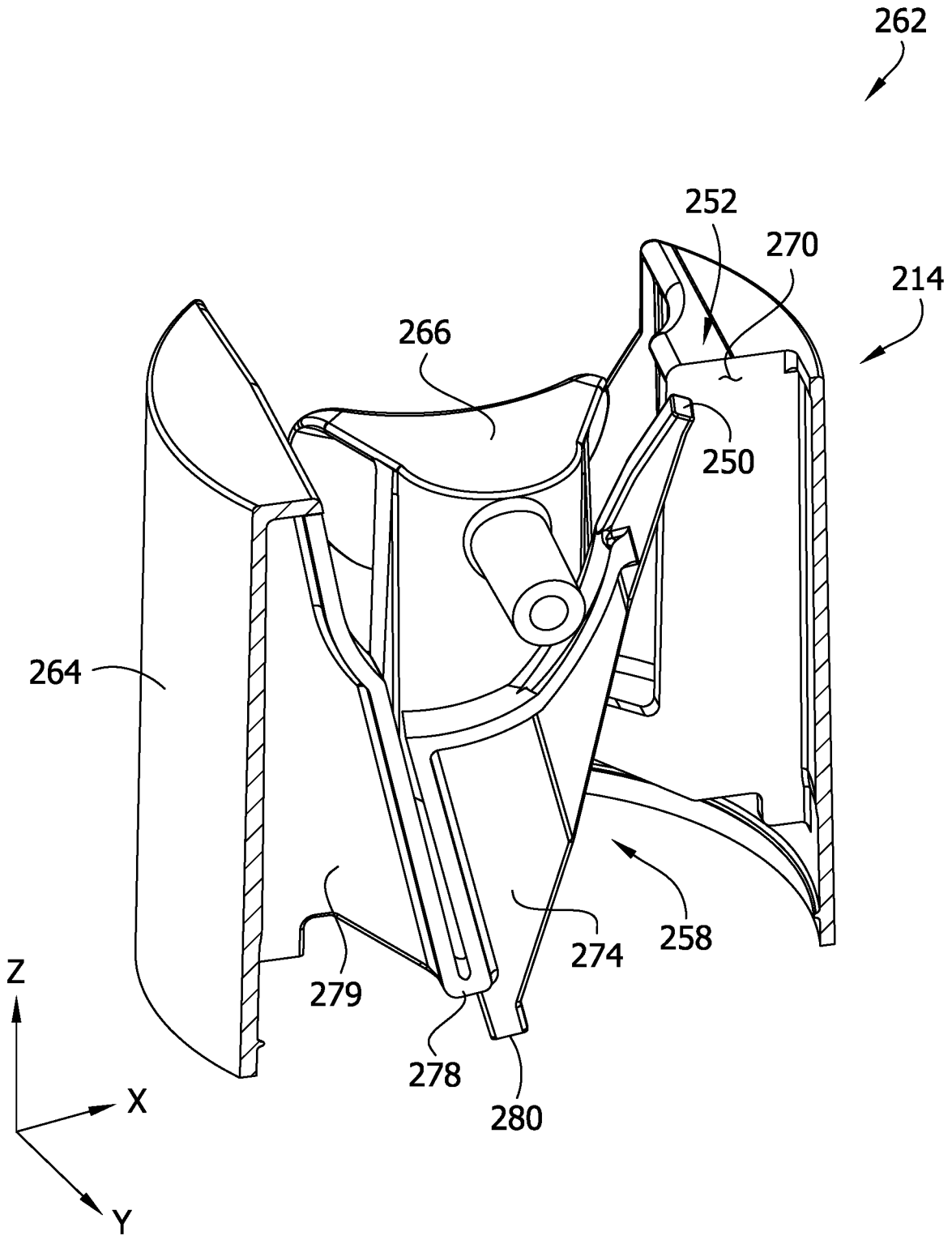
FIG. 13 is a perspective of the cap of FIG. 10, a portion of the cap broken away to show internal structure.

In this embodiment, an illustrated scale 252 of the pressure gauge 214 includes a window 270 (e.g., a horizontal slot) defined by the shroud 264 at an upper end thereof and through which a pointer 250 of the pressure gauge is visible. Together, the pointer 250 and the scale 252 may be considered a visual indicator of the pressure gauge 214. In this embodiment, the window 270 extends in a direction that is generally perpendicular to the direction the nozzle 266 directs the flowable product in. In the illustrated embodiment, when the aerosol container assembly (e.g., fire suppressor) 10 has an internal pressure at or above a threshold pressure, the pointer 250 is disposed at or near an inner end of the window 270 (e.g., the end closest to the nozzle 266), as shown in FIG. 13, adjacent to indicia of the scale 252 (e.g., "CHARGED," as illustrated in FIG. 10), indicating that the container is suitable for use. When the aerosol container assembly 10 does not have an internal pressure at or above a threshold pressure, the pointer 250 is disposed outward from the inner end of the window 270 (e.g., toward the end furthest from the nozzle 266) adjacent to indicia of the scale 252 (e.g., "DISPOSE," as illustrated), indicating that the container is not suitable for use (FIG. 10). In this manner, the pointer 250 moves along a longitudinal axis defined by the window 270 (e.g., a first direction) to indicate the pressure within the aerosol container 12. In other embodiments, the indicia of the scale 252 may include different colors such as a band of the color green to indicate the aerosol container assembly 10 is suitable for use and a band of the color red to indicate the container is not suitable for use.

Figure 11:
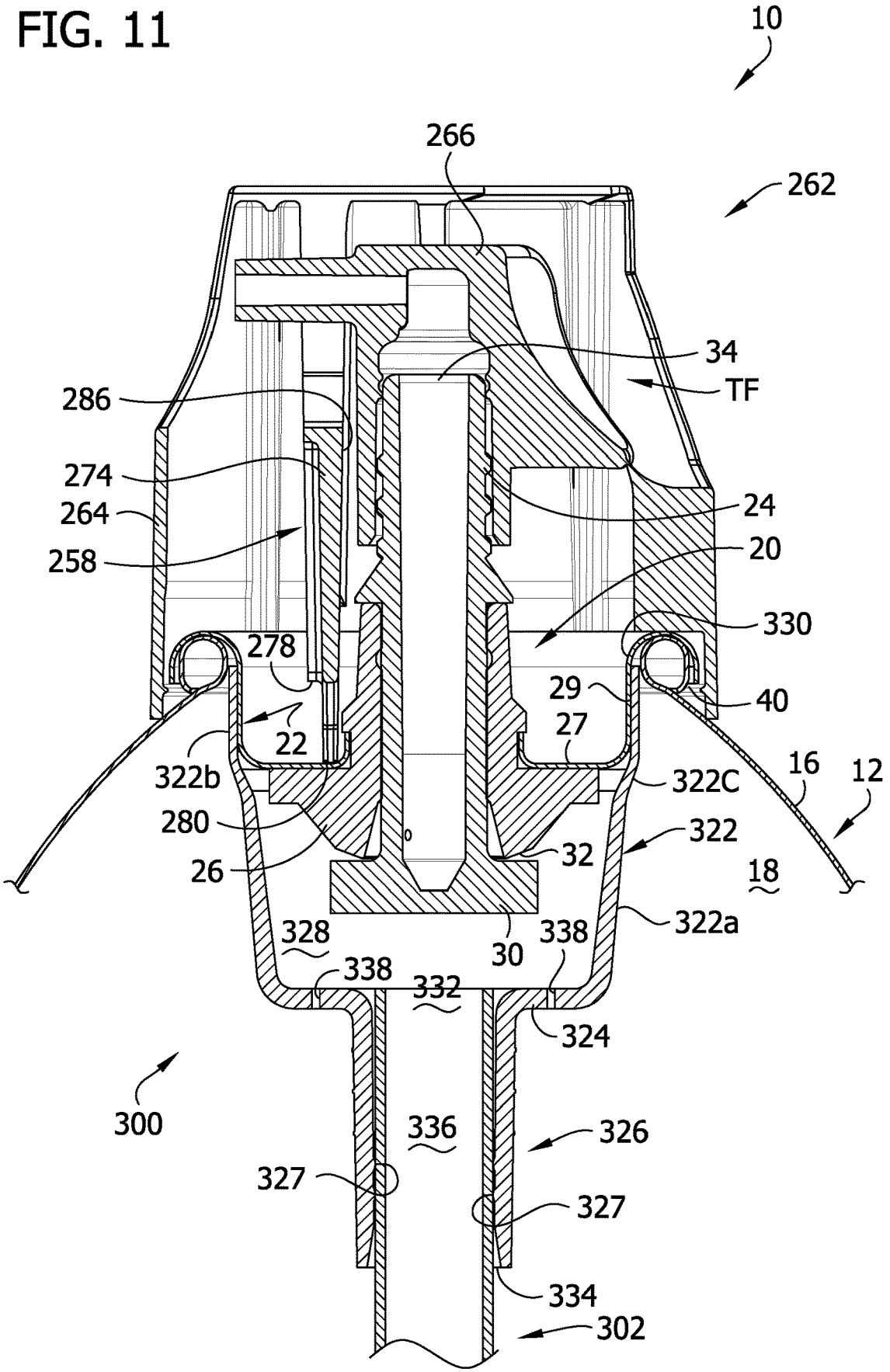
FIG. 11 is an enlarged cross section of an upper end of a fire suppressor including the cap of FIG. 10 and a dip tube adaptor.
Figure 12:
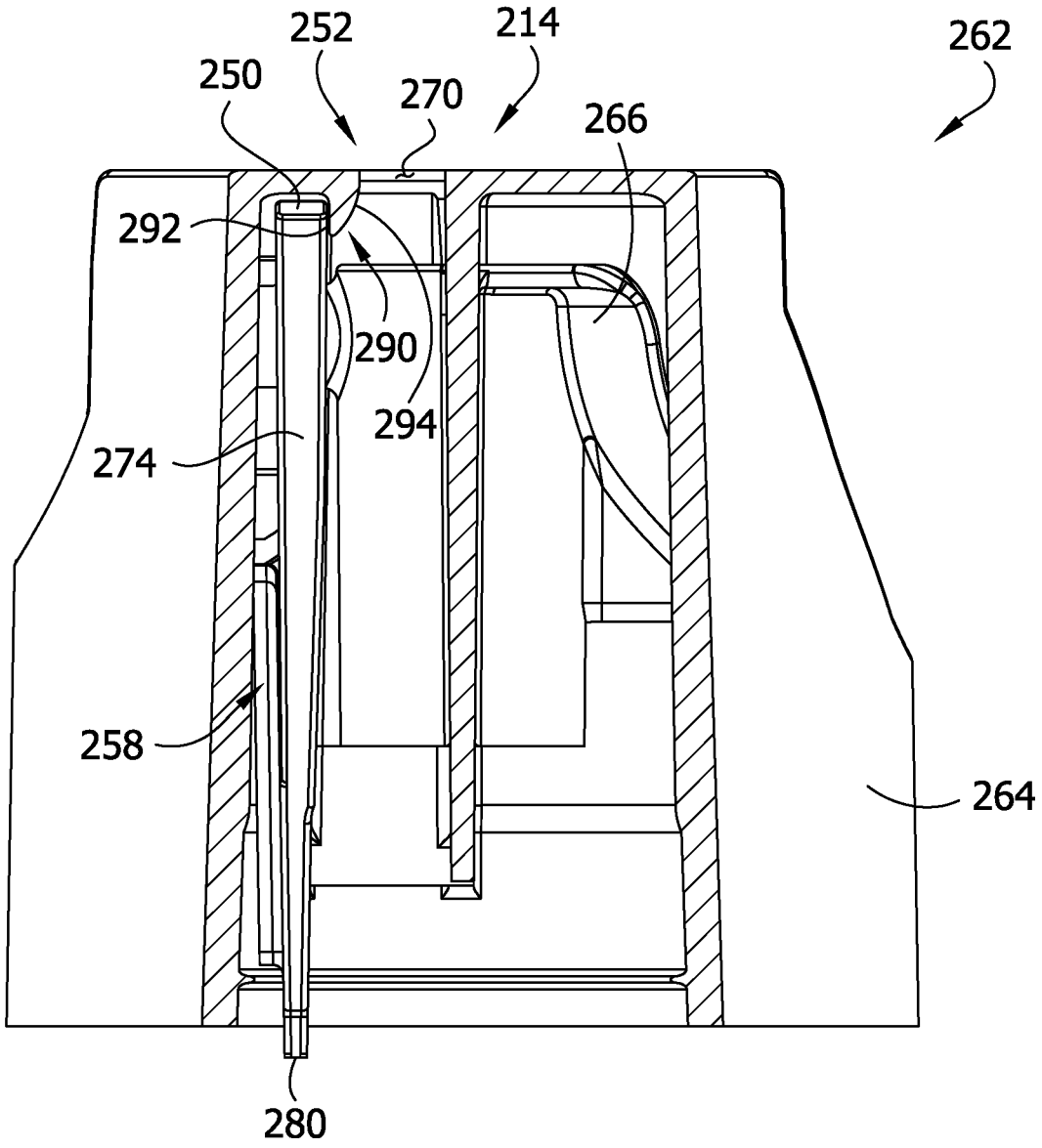
FIG. 12 is a cross section of the cap of FIG. 10, with a pointer of the cap in a captured position.

In this embodiment, the illustrated pressure gauge 214 further includes a mechanical amplifier, generally indicated at 258, to amplify the heightwise position of the valve assembly 20 relative to the upper end (e.g., the bead 40) of the container body 16 and transmit the amplified position to the pointer 250. The illustrated mechanical amplifier 258 includes a linkage mechanism coupling the valve assembly 20 to the pointer 250. The linkage mechanism of a mechanical amplifier 258 includes an elongate lever, generally indicated at 274, that pivots about a fulcrum relative to the scale 252 in response to the heightwise displacement of the valve assembly 20. The lever 274 includes a lower end (e.g., coupling end) 280 that interfaces with the valve assembly 20, and more particularly, with the bottom wall 27 of the mounting cup 22 and an upper end (e.g., free end), which in the illustrated embodiment, forms the pointer 250 that is visible through the window 270. A living hinge 278 hingedly connects the lever 274 to the shroud 264, and more particularly, to a flange 279 extending from the shroud into a cap interior defined by the cap 262. The living hinge 278 hingedly connects to the lever 274 at a location between the coupling and free ends thereof, and more particularly, adjacent or near the coupling end 280 of the lever. As such, in the illustrated embodiment, the lever 274 and the pointer 250 are integrally formed as a one-piece component, although in other embodiments, the components may be formed separately. It is understood the position of the living hinge 278 relative to the coupling end 280 of the lever 274 defines the multiplier of the mechanical amplifier 258 the mechanical signal is amplified by, mentioned above. The illustrated coupling end 280 of the lever 274 has a flat surface that rests on the top of the bottom wall 27 of the mounting cup 22 (FIG. 11). As a result, any heightwise displacement/movement of the bottom wall 27 relative to the container body 16 moves the coupling end 280 in the heightwise direction and, thereby, moves the pointer 250 in the window 270. In other embodiments, the coupling end 280 may engage another component of the valve assembly 20, (e.g., the stem 24 or the seal 26) that experiences heightwise displacement in response to the internal pressure of the aerosol container 12. As can be understood, the lever 274 pivots (e.g., rotates) about the living hinge 278 in a first rotational direction (e.g., about a y-axis extending through the living hinge; FIG. 13) in response to heightwise movement of the bottom wall 27 due to changes in internal pressure in the aerosol container 12 and imparts movement of the pointer 250 relative to the scale 252, as explained above with respect to the previous embodiments.

In this embodiment, the pointer 250 is also movable relative to the scale 252 in response to the movement (e.g., generally horizontal displacement) of the nozzle 266 to indicate if the aerosol container assembly 10 has dispensed any flowable product (e.g., a first use indicator). In the illustrated embodiment, when the aerosol container assembly 10 has never dispensed any flowable product (e.g., is waiting to be used for the first time), the pointer 250 is disposed in the window 270 such that the pointer is visually noticeable, indicating that the container has not been used. It is understood that the pointer 250 can still indicate the internal pressure of the aerosol container 12 in this case. As described in more detail below, after the aerosol container assembly 10 has dispensed flowable product for the first time, the pointer 250 is no longer disposed in the window 270 such that the pointer is no longer visually noticeable, indicating that the container has been used.

Still referring to FIGS. 10-14, in this embodiment, the cap 262 includes a detent or catch 290 (FIG. 12) configured to engage and lock the pointer 250 in a position spaced apart from the window 270 so that the pointer is no longer visually noticeable in the window. The catch 290 is disposed adjacent to or at the front side of the window 270. The illustrated catch 290 includes a shoulder 292 opposite the window 270 and configured to engage the pointer 250 such that the pointer is captured by the shoulder 292 and held away from the window. In the illustrated embodiment, the shoulder 292 is a generally flat surface that extends in the heigthwise direction in front of the window 270. Preferably, the shoulder 292 extends a sufficient vertical distance below the window 270 so that the catch 290 captures the pointer 250 regardless of the amount of pressure in the aerosol container 12. The catch 290 also includes an inclined or ramped surface 294 extending at a downward angle from the window 270 to the shoulder 292 (e.g., the catch is tapered). The illustrated catch 290 is attached to the shroud 264 and integrally formed therewith, although in other embodiments, the components may be formed separately.

The level 274 is configured to be engaged and moved by the nozzle 266 when the nozzle is moved in the forward direction by the tilt force TF applied by the operator. In the illustrated embodiment, the level 274 (broadly, at least a portion thereof) is disposed in front of the nozzle 266 and has a contact surface 286 facing the nozzle (FIG. 11). The contact surface 286 is in a close, but spaced apart relationship with the nozzle 266. In other embodiments, the contact surface 286 and the nozzle 266 may not be spaced apart. When the nozzle 266 is pushed forward, the nozzle contacts and pushes the lever 274 in a forward direction. In particular, when the nozzle 266 engages the lever 274, the lever pivots (e.g., rotates) about the living hinge 278 in a second rotational direction (e.g., about an x-axis extending through the living hinge) that is generally transverse to the first rotational direction and, thereby, moves the pointer 250 in the forward direction and out of the window 270 (e.g., the pointer is resiliently deflected in the forward direction). The illustrated pointer 250 moves along an axis generally transverse to the longitudinal axis defined by the window 270 (e.g., a second direction).

As the pointer 250 is moved out of the window 270, the pointer engages the catch 290, in particular the ramped surface 294, and resiliently deflects downward (via the living hinge 278) as the pointer moves along the ramped surface. Once the pointer 250 is moved past the catch 290 by the nozzle 266, the pointer 250 returns to its original vertical position (e.g., moves upward) and engages the shoulder 292. In this captured position (FIG. 12), the engagement between the shoulder 292 and the pointer 250 prevents the pointer from returning to its original position in the window 270, thereby hiding the pointer from the operator's view and visually indicating the aerosol container assembly 10 has been used. Preferably, the minimum forward distance the nozzle 266 must move the lever 274 in order for the catch 290 to capture the pointer 250 is less than the forward distance the nozzle must move in order to actuate the valve assembly 20 to dispense flowable product from the aerosol container assembly 10. In other words, the nozzle 266 moves the lever 274 to (and possibly past) a catch position, the minimum forward point the lever must reach in order for the catch 290 to capture the pointer 250, before the nozzle reaches a dispensing position, the point where the valve assembly 20 is actuated and flowable product is dispensed from the aerosol container assembly 10. In this manner, the catch 290 will capture the pointer 250 the first time the nozzle 266 is pushed to dispense flowable product from the aerosol container assembly 10.

Figure 14:
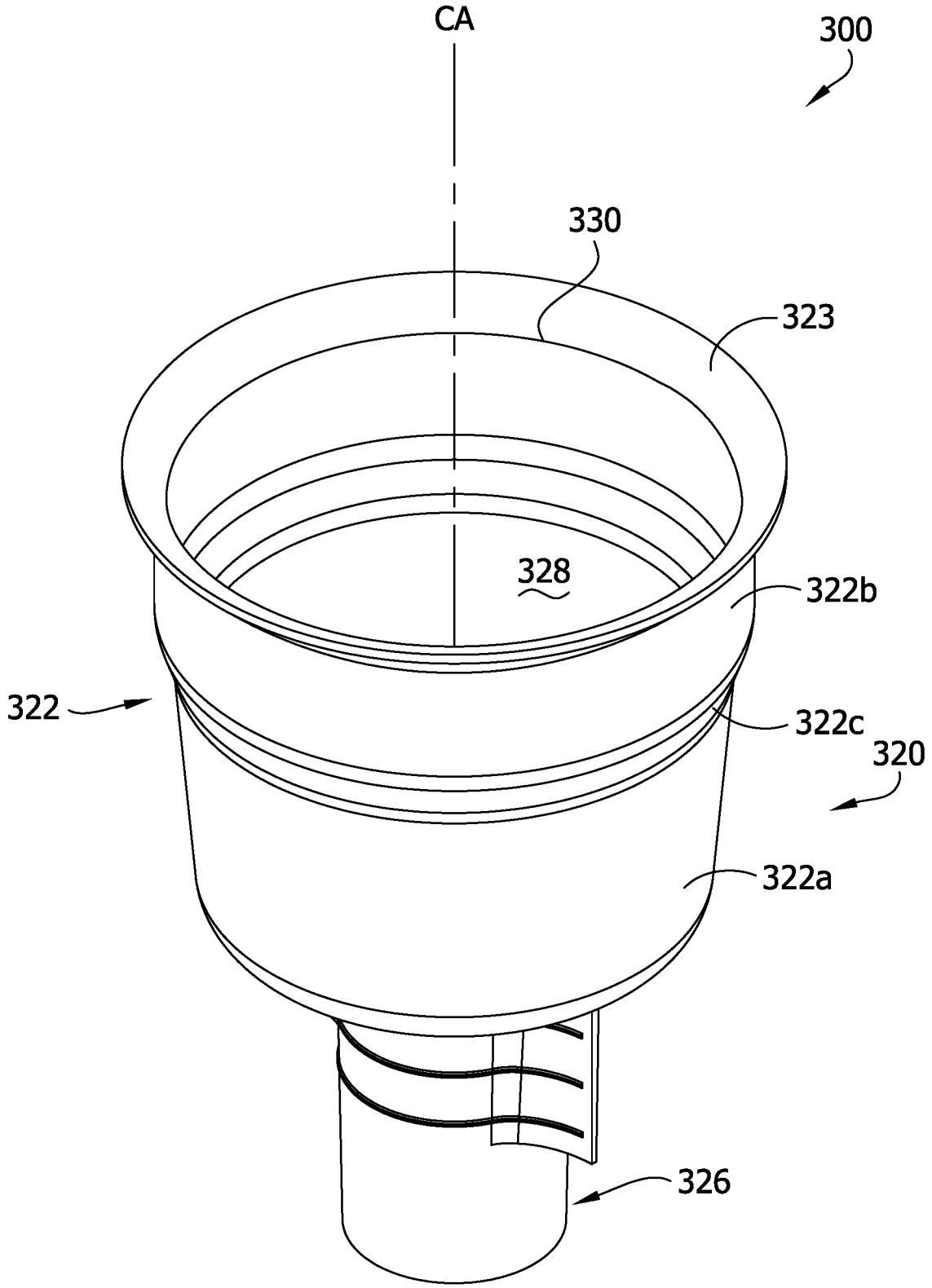
FIG. 14 is a perspective of the dip tube adaptor of FIG. 11.
Figure 15:
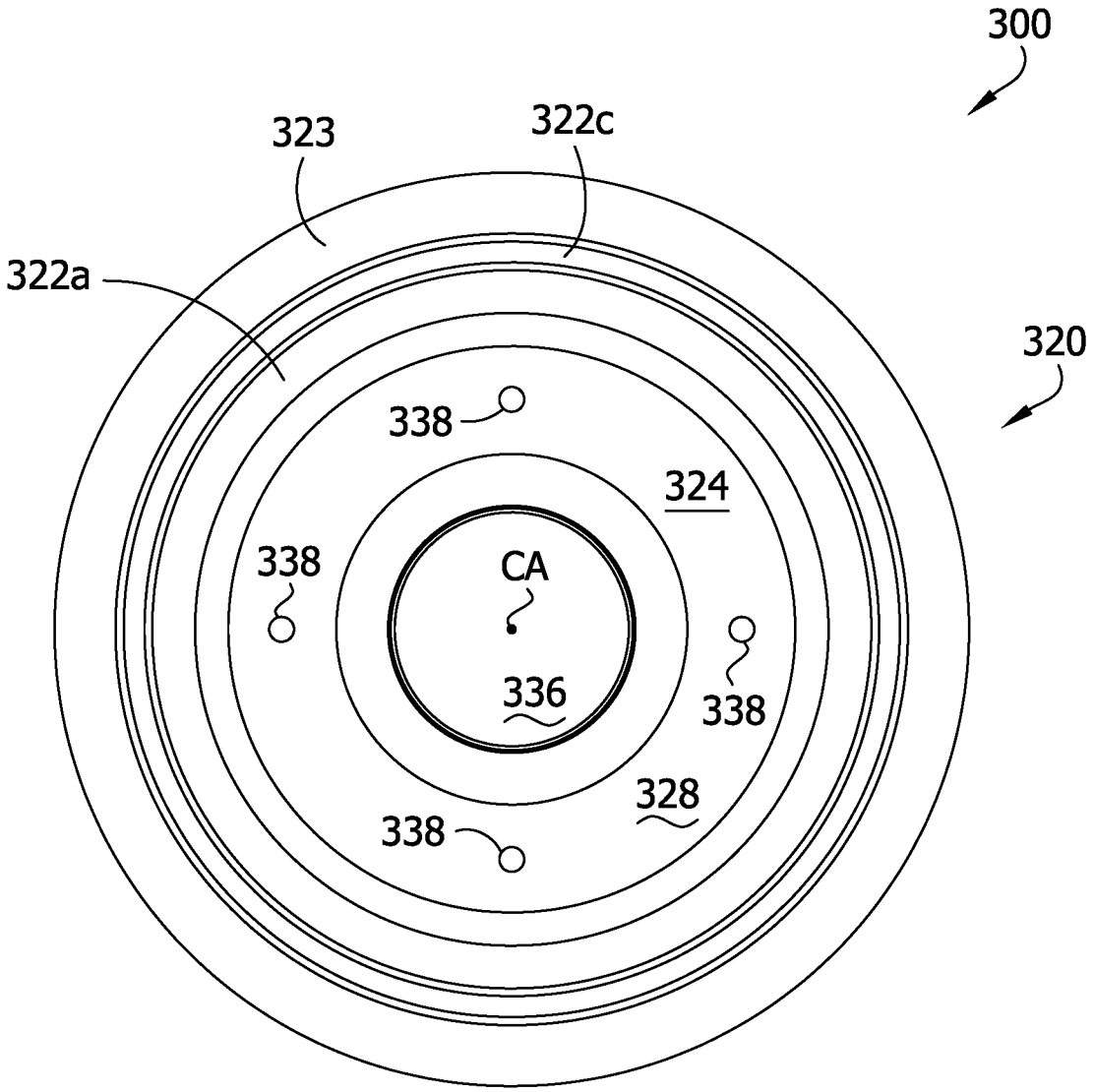
FIG. 15 is a top view of the dip tube adaptor.

Referring to FIGS. 11, 14 and 15, in one embodiment of an aerosol container assembly 10 for dispensing a flowable product, a dip tube adaptor, generally indicated at 300, is connected to the valve assembly 20. The dip tube adaptor 300 is configured to foam or froth the flowable product before the flowable product is dispensed through the valve, as described in more detail below. In this embodiment, the aerosol container assembly 10 contains the flowable product (e.g., fire suppressant) in the bottom portion of the interior 18 and the propellant in the upper portion of the interior adjacent the valve assembly 20 (when the container is in a generally upright position). A dip tube 302, as generally known in the art, is fluidly connected to the valve assembly 20 by the dip tube adaptor and extends downward through the interior 18 of the aerosol container 12 into the flowable product. When the valve assembly 20 is actuated, the propellant forces the flowable product up through the dip tube 302, through the dip tube adaptor 300 and the valve assembly 20 (e.g., stem 24) and into the nozzle 266.

The illustrated dip tube adaptor 300 includes a housing or body 320 having an upper end configured to be coupled to the valve assembly 20 and a lower end configured to be coupled to the dip tube. The housing 320 includes a generally annular or cylindrical upper wall 322 defining a central axis CA, a base 324 extending radially inward (e.g., toward the central axis CA) from a lower end of the upper wall. In the illustrate embodiment, the upper wall 322 includes a lower portion 322*a*, an upper portion 322*b* and a transition portion 322*c* extending between and interconnecting the upper and lower portions. The lower portion 322*a* of the upper wall 322 extends slightly radially outward (e.g., way from the central axis CA) as the lower portion extends from the base 324 to the transition portion 322*c*. The upper portion 322*b* of the upper wall 322 extends generally vertically upward from the transition portion 322*c*. The upper portion 322*b* of the upper wall 322 has a diameter that is larger than a diameter of the lower portion 322*a*. The housing 320 also includes a generally annular or cylindrical lower wall 326, an upper end of which is connected to the base 324. The diameter of the upper wall 322 is larger than the diameter of the lower wall 326. The illustrated upper wall 322 is configured to couple to the mounting cup 22 by engaging and forming a leak proof seal with a side wall 29 of the mounting cup and the lower wall 326 is configured to couple to the dip tube 302 by engaging and forming a leak proof seal with an upper end of the dip tube. In other embodiments, the dip tube adaptor 300 and dip tube 302 may be integrally formed as a single, one-piece component.

The housing 320, in particular the upper wall 322 and base 324, defines a mixing chamber 328. An upper end of the upper wall 322 is free and defines an open top 330 of the mixing chamber 328. The base 324 defines a base opening (broadly, a flowable product inlet) 332 in fluid communication with the mixing chamber 328. A lower end of the lower wall 326 defines a dip tube opening 334 in fluid communication with the mixing chamber 328 and sized and shaped to receive the dip tube 302 therein. In one embodiment, the dip tube opening 334 is sized and shaped to receive a dip tube 302 having an inner diameter of about 0.25 in (6.3 mm) for an area (e.g., cross-sectional area) of about 0.05 $in^2$ (31.2 $mm^2$). The lower wall 326 defines a fluid passageway 336 between the dip tube opening 334 and the flowable product inlet 332. The fluid passageway 336 is sized and shaped to receive the dip tube 302 along at least a portion of its longitudinal length to fluidly connect the dip tube 302 to the mixing chamber 328. Thus, the dip tube opening 334, fluid passageway 336, flowable product inlet 332, mixing chamber 328 and open top 330 are all in fluid communication with one another. In addition, the housing 320, in particular the base 324, defines at least one propellant inlet 338 in fluid communication with the mixing chamber 328. Each propellant inlet 338 is in constant (e.g., continuous, uninterrupted) fluid communication with the mixing chamber 328. Each propellant inlet 338 is small and has a diameter of about 0.04 in (1 mm) for an area (e.g., cross-sectional area) of about 0.0012 $in^2$ (0.8 $mm^2$). The housing 320 may have other configurations without departing from the scope of the present disclosure. For example, the upper wall 322 may define propellant inlets 338.

The housing 320 preferably includes a plurality of propellant inlets 338. The illustrated housing 320 defines four propellant inlets 338, although the housing may include more or less than four propellant inlets. The propellant inlets 338 are spaced apart (e.g., evenly spread out) on the base 324. The illustrated propellant inlets 338 extend generally vertically through the base 324, although in other embodiments, the propellant inlets 338 may extend at other orientations through the housing 320.

Referring to FIG. 11, when the dip tube adaptor 300 is coupled to the mounting cup 22 and the dip tube 302, the dip tube adaptor fluidly connects the dip tube 302 and the valve assembly 20. When the dip tube adaptor 300 is coupled to the mounting cup 22, a lower portion of the valve assembly 20 (e.g., mounting cup 22, stem 24, and gasket 26) extends through the open top 330 and into the mixing chamber 328. In this manner, the mixing chamber is fluidly connected to the valve assembly 20. The upper wall 322 extends over and engages the side wall 29 of the mounting cup 22 to form the leak proof seal between the components. Specifically, at least a portion of the upper portion 322*b* of the upper wall 322 extends along and engages at least a portion of the side wall 29 of the mounting cup 22 (e.g., the inner diameter of the upper portion corresponds to (e.g., is substantially the same as) the outer diameter of the side wall). Similarly, the lower wall 326 is inserted over (e.g., receives) the upper end of the dip tube 302. The dip tube 302 extends in and engages at least a portion of the lower wall 326 to form a friction fit and leak proof seal between the components. In the illustrated embodiment, the dip tube 302 extends along the entire longitudinal length of the lower wall 326 such that the upper end of the dip tube 302 is disposed in the flowable product inlet 332. In one embodiment, the lower wall 326 includes at least one interior, circumferential rib 327 extending into the fluid passageway 336 that is configured to engage the dip tube 302 and form the friction fit and leak proof seal. In one embodiment, a lip 323 (FIGS. 14 and 15) extends from the upper end of the upper wall 322 and is configured to be disposed between the mounting cup 22 and the bead 40 when the mounting cup is crimped or clinched on the bead (e.g., the lip is crimped or clinched as well) to further facilitate the formation of the leak proof seal between the dip tube adaptor 300 and the mounting cup.

When the dip tube adaptor 300 connected to the valve assembly 20, each propellant inlet 338 is disposed in and in fluid communication with the upper portion of the interior 18 of the aerosol container 12. Accordingly, each propellant inlet 338 provides constant fluid communication between with the upper portion of the interior 18 and the mixing chamber 328. The housing 320 is also spaced apart from the lower portion of the stem 24 and gasket 26 to provide the necessary clearance for the stem and gasket to move when the valve assembly 20 is actuated. The upper wall 322 has a height that is sufficient to dispose the base 324 in a spaced apart position below the stem 24 when the upper wall extends along the mounting cup 22. Likewise, the inner diameter of the lower portion 322*a* of the upper wall 322 is larger than the diameters of the stem 24 and gasket 26.

When an actuator, such as nozzles 66, 166, 266, actuates the valve assembly 20 to dispense flowable product form the aerosol container 12, the flowable product moves through the dip tube adaptor 300 and into the valve assembly. In particular, when the valve assembly 20 is actuated, the pressurized propellant forces (e.g., pushes) the flowable product in the lower end of the interior 18 of the aerosol container 12 up into and through the dip tube 302. The flowable product then moves into the mixing chamber 328 through the flowable product inlet 332. Simultaneously, with the flowable product moving into the mixing chamber 328, the pressurized propellant in the upper end of the interior 18 moves into the mixing chamber through each propellant inlet 338. The flowable product and propellant mix in the mixing chamber 338 which froths (e.g., foams) the flowable product therein. In particular, each propellant inlet 338 directs the propellant into the flowable product contained within the mixing chamber to create turbulence therein, frothing the flowable product. Once the flowable product and the propellant mix in the mixing chamber 328, the resulting frothed flowable product moves through the mixing chamber and into the valve assembly 20 and is then dispensed from the aerosol container 12, in the frothed state. It is understood the mixing cup 300 can be used with valve assemblies of other designs and constructions without departing from the scope of the present disclosure. Further, it is understood the mixing cup 300 can be used with any of the caps 62, 162, 262 (e.g., nozzles 66, 166, 266 and pressure gauges 14, 114, 214) described herein.

The direction the propellant inlet 338 extends through the housing 338 corresponds to the direction the propellant inlet directs the propellant in. The illustrated propellant inlets 338 extend vertically upward through the housing 320, accordingly, these propellant inlets direct the propellant vertically upward in the mixing chamber 338. In other embodiments, the one or more propellant inlets 338 may direct the propellant in other directions such as directions that are non-parallel and/or crosswise to the direction of the flow of the flowable product through the mixing chamber 338. In one embodiment, each propellant inlet 338 may direct the propellant toward the central axis CA. In another embodiment, each propellant inlet 338 may direct the propellant in a different direction. It can be understood that the direction the propellant inlet(s) 338 direct the propellant in contributes to the degree or amount of turbulence created in the mixing chamber 328 and, therefore, the degree or amount of frothing the flowable product experiences.

In general, the both flowable product and propellant move (e.g., flow) into the mixing chamber 338 of the housing 320 when the valve assembly is actuated because of the relative areas of the dip tube 302 and the propellant inlets 338. In particular, because the combined area of the propellant inlets 338 is less (e.g., significantly less) than the area of the dip tube 302, both flowable product and propellant flow into the mixing chamber. In one example, the combined area of all the propellant inlets 338 may be from about 5 to 20 times less than the area of the dip tube 302, or from about 5-15 times less, or about 8-12 times less. For example, the illustrated four product inlets 338 have a combined area (0.0048 $in^2$ (3.2 $mm^2$)) that is about 10 times less than the area (0.05 $in^2$ (31.2 $mm^2$)) of the dip tube 302 (e.g., a ratio of 1 to 10). It is understood that the relative areas of the propellant inlets 338 and the dip tube 302 may vary based on the amount or degree of frothing (e.g., foaming) desired, the type of flowable product, and/or the type of propellant. Accordingly, other ratios of the combined propellant inlet(s) 338 area to the dip tube's 302 area are within the scope of the present disclosure.

Modifications and variations of the disclosed embodiments are possible without necessarily departing from the scope of the invention defined in the appended claims. For example, where specific dimensions are given, it will be understood that they are exemplary only and other dimensions are possible.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A pressure gauge for an aerosol container including a container body and a valve assembly secured to the container body, the pressure gauge comprising:

a scale configured to be attached to the aerosol container;

a pointer associated with and movable relative to the scale, wherein the pointer is configured to be operatively coupled to the valve assembly such that the pointer moves relative to the scale in response to movement of at least a portion of the valve assembly due to internal pressure in the container body to provide a reading; and a mechanical amplifier configured to amplify movement of the pointer imparted by movement of the portion of the valve assembly due to internal pressure in the container body.

2. A pressure gauge for an aerosol container as set forth in claim 1, wherein the mechanical amplifier amplifies the movement of the pointer relative to the movement of the portion of the valve assembly by a multiplier that is from about 2.5 to about 5.

3. A pressure gauge for an aerosol container as set forth in claim 1, wherein the mechanical amplifier is configured to engage a stem of the valve assembly such that movement of the stem due to internal pressure in the container body moves the pointer relative to the scale.

4. A pressure gauge for an aerosol container as set forth in claim 1, wherein the mechanical amplifier includes a lever.

5. A pressure gauge for an aerosol container as set forth in claim 4, wherein the lever includes a free end which forms the pointer.

6. A pressure gauge for an aerosol container as set forth in claim 5, wherein the lever has a connected end opposite the free end, the connected end being connected to a hinge such that the lever pivots about the hinge in response to movement of the portion of the valve assembly to move the pointer relative to the scale.

7. A pressure gauge for an aerosol container as set forth in claim 6, wherein the hinge is a living hinge.

8. A pressure gauge for an aerosol container as set forth in claim 6, wherein the pressure gauge is part of an actuator configured to be attached to the aerosol container and actuate the valve assembly, wherein the actuator includes a shroud and the hinge connects the lever to the shroud.

9. A pressure gauge for an aerosol container as set forth in claim 1, wherein the pointer is configured to indicate when the aerosol container has dispensed a flowable product from the aerosol container.

10. A pressure gauge for an aerosol container as set forth in claim 9, wherein the pointer moves in a first direction relative to the scale to indicate the internal pressure in the container body and the pointer moves in a second direction relative to the scale to indicate when the aerosol container has dispensed the flowable product from the aerosol container.

11. A pressure gauge for an aerosol container as set forth in claim 10, wherein the pointer is configured to move in the second direction to indicate when aerosol container has dispensed the flowable product when the valve assembly is actuated to dispense the flowable product.

12. A pressure gauge for an aerosol container as set forth in claim 10, wherein the scale further includes a window, the pointer being disposed in the window to indicate the aerosol container has not dispensed the flowable product from the aerosol container and the pointer being disposed apart from the window to indicate the aerosol container has dispensed at least some of the flowable product from the aerosol container.

13. A pressure gauge for an aerosol container as set forth in claim 12, further comprising a catch configured to capture and hold the pointer apart from the window to indicate the aerosol container has dispensed at least some of the flowable product from the aerosol container.

14. An aerosol container assembly for a flowable product, the aerosol container assembly comprising:

a container body defining an interior configured to contain the flowable product under pressure;

a valve assembly secured to the aerosol container; and a pressure gauge for detecting the internal pressure in the container body, the pressure gauge including a scale attached to the container body;

a pointer associated with and movable relative to the scale, wherein the pointer is operatively coupled to the valve assembly such that the pointer moves relative to the scale in response to movement of at least a portion of the valve assembly due to internal pressure in the container body to provide a reading; and a mechanical amplifier configured to amplify movement of the pointer imparted by movement of the portion of the valve assembly due to internal pressure in the container body.

15. An aerosol container assembly for a flowable product as set forth in claim 14, wherein the mechanical amplifier includes a lever.

16. An aerosol container assembly for a flowable product as set forth in claim 14, wherein the pointer is configured to indicate when the aerosol container assembly has dispensed the flowable product from the container body.

17. An aerosol container assembly for a flowable product as set forth in claim 14, further comprising a dip tube and a foaming chamber coupled to and providing fluid communication between the valve assembly and the dip tube, the foaming chamber defining:

a mixing chamber in fluid communication with the valve assembly;

a flowable product inlet providing fluid communication between the mixing chamber and the dip tube; and at least one propellant inlet providing constant fluid communication between the mixing chamber and the interior of the container body;

wherein the flowable product flows into the mixing chamber through the dip tube and flowable product inlet and, simultaneously therewith, the propellant flows into the mixing chamber through the at least one propellant inlet when the valve assembly is selectively operated to dispense the flowable product from the container body, wherein the flowable product and propellant mix in the mixing chamber such that the flowable product foams before moving into the valve assembly.

* * * * *